United States Patent [19]

Hirano et al.

[11] Patent Number: 4,678,415

[45] **Date of Patent: * Jul. 7, 1987**

[54] ROTARY TYPE FLUID MACHINE

[75] Inventors: Takahisa Hirano; Kiyoshi Hagimoto, both of Nagoya, Japan

[73] Assignee: Mitsubishi Jukogyo Kabushiki Kaisha, Japan

[ * ] Notice: The portion of the term of this patent subsequent to Jul. 7, 2004 has been disclaimed.

[21] Appl. No.: 738,049

[22] Filed: May 24, 1985

[30] Foreign Application Priority Data

May 25, 1984 [JP] Japan ..... 59-105970
May 28, 1984 [JP] Japan ..... 59-108008
May 31, 1984 [JP] Japan ..... 59-111658

[51] Int. Cl.[4] ..... F01C 1/02
[52] U.S. Cl. ..... 418/50; 418/150
[58] Field of Search ..... 418/50, 150; 92/89

[56] References Cited

U.S. PATENT DOCUMENTS 4,417,863 11/1983 Ikegawa et al. ..... 418/55
4,441,870 4/1984 Ikegawa et al. ..... 418/55
4,498,852 2/1985 Hiraga ..... 418/55
4,540,355 9/1985 Sakaki et al. ..... 418/55
4,547,137 10/1985 Terauchi et al. ..... 418/55

FOREIGN PATENT DOCUMENTS 101285 6/1983 Japan ..... 418/150

*Primary Examiner*—Robert E. Garrett
*Assistant Examiner*—John Kwon
*Attorney, Agent, or Firm*—McGlew and Tuttle

[57] ABSTRACT

A rotary type fluid machine including a stationary spiral element and a revolving spiral element respectively having a substantially identical configuration and disposed therein 180 degrees apart from each other in mutually nested relationship, the revolving spiral element being adapted to revolve in solar motion relationship with respect to the stationary spiral element with a radius of revolutionary motion $\rho$, wherein the both spiral elements are respectively defined in profile with a radially outer curve segment consisting of an involute curve, a radially inner curve segment consisting of another involute curve in an inside arc having a radius R, and an arc having a radius r connecting smoothly the radially outer curve segment and the arc having the radius R, thereby ensuring a smallest possible error in the machining and thereby reducing a work period of time on the spiral elements; or wherein there is provided a small gap or clearance between the both spiral elements when installed in a mutual engagement relationship in such a manner that the whole inner and connection curves or part thereof defining the profile of the spiral elements may be caused to be departed out of the mutual engagement relationship in the range between marginal points for defining a due involute curve therefor, thereby ensuring a long service life and a high efficiency performance of the entire rotary type fluid machine.

3 Claims, 24 Drawing Figures

ROTARY TYPE FLUID MACHINE

BACKGROUND OF THE INVENTION (i) Field of the Invention

The present invention relates generally to a rotary machine, and more specifically to a rotary type fluid machine.

(ii) Description of the Prior Art

The typical construction of a scroll-type compressor, for instance, generally known in art of the fluid compression machines as shown in FIG. 10, a schematic view showing the general principle of operation, is such that there are provided two scroll or spiral elements of an identical cross-sectional shape, one spiral element 2 being fixed in position onto the surface of a sealing end plate having a generally central delivery opening 4. Further to this construction, these two spiral elements are shifted in rotation relatively 180 degrees apart from each other and are also shifted in relative location by a distance 2 $\rho$(=the pitch of a spiral pattern $-2$ X thickness of a spiral element plate) so as to be nested in position with each other in such a manner as schematically shown in the figure that they may be located in their relative position to come in abutting contact with each other at four points 51, 52 and 51', 52'. According to this construction, it is further noted that the one spiral element 2 is disposed stationary in position, and the other element 1 is arranged to move in revolution or in solar-orbital motion with a radius of $\rho=0$, 0' about the center 0 of the spiral element 2, without moving in rotation or in planetary motion on its own axis, by using a crank mechanism having a radius $\rho$.

With such construction, there are defined small spaces or chambers 3, 3 being tightly enclosed extending along and between the abutting points 51, 52 and 51', 52' of the spiral elements 1, 2, respectively, the volumes of which chambers 3, 3 vary gradually in continuation with the solar or revolving motion of the spiral element 1.

Reviewing more specifically, it is notable that when the spiral element 1 is firstly caused to be revolved 90 degrees starting from the position shown in FIG. 10 (A), it turns now to be in the state as shown in FIG. 10 (B), when it is revolved 180 degrees, then it turns to be in the state as shown in FIG. 10 (C), and when it is further revolved 270 degrees, it turns then to be in the state as shown in FIG. 10 (D). As the spiral element 1 moves along in revolution, the volumes of the small chambers 3, 3 decrease gradually in continuation, and eventually, these chambers come in communication with each other and merge into one tightly enclosed small chamber 53. Now, when it moves in revolution further 90 degrees from the state shown in FIG. 10 (D), it turns back to the state in position as shown in FIG. 10 (A), and the small chamber 53 would then be caused to be reduced in its volume as it turns from the state shown in FIG. 10 (B) to that shown in FIG. 10 (C), and eventually it would turn to a smallest volume intermediate the states shown in FIGS. 10 (C) and (D). During this stage of motion in revolution, outer spaces starting to be opened as seen in FIG. 10 (B) get grown to be greater as the element 1 turns along from the state of FIG. 10 (C) through the state of FIG. 10 (D) to the state of FIG. 10 (A), thus introducing another volume of a fresh air from these outer spaces into the tightly enclosed small chamber to be eventually merged together, and then repeating this cycle of revolutionary motion so that the gas thus-taken into the outer spaces of the spiral elements may accordingly be compressed, thus being delivered out of the delivery opening 4.

The foregoing description is concerned with the general principle of operation of the scroll-type compressor, and now, referring more concretely to the construction of this scroll-type compressor by way of FIG. 11 showing in longitudinal cross-section the general construction of the compressor, it is seen that a housing 10 is comprised of a front end plate 11, a rear end plate 12 and a cylinder plate 13. The rear end plate 12 is provided with an intake port 14 and a delivery port 15 both extending outwardly therefrom, and further installed securely with a stationary scroll member 25 comprising a spiral or helical fin 252 and a web disc 251. The front end plate 11 is adapted to pivotally mount a spindle 17 having a crank pin 23. As typically shown in FIG. 12 which is a transversal cross-sectional view taken along the plane defined by the arrow XII—XII in FIG. 11, in mutually operative relationship with the crank pin 23 there is seen provided a revolving scroll member 24 including a spiral element 242 and a disc 241, through a revolving mechanism, which comprises a radial needle bearing 26, a boss 243 of the revolving scroll member 24, a square-section sleeve member 271, a slider element 291, a ring member 292 and a stopper lug 293 and the like.

The practice of design engineering of the general configuration of the scroll or spiral elements 1, 2 to be incorporated in the scroll-type compression machine is, as described in detail in the Japanese Patent Application No. 197,672/1981 filed by the present inventors, such that the major parts of the radially inner and outer profile curves of these spiral elements may generally be designed consisting of the involute functions. As stated also in the description on the principles of operation of this type compression machine given above, the small chamber 53 would change in reduction its working volume for a certain part of its operation cycle, thus providing the delivery of high pressure fluid out of the delivery port. In connection with this cycle of operation, there is encountered the phenomenon of so-called "top clearance volume" arising from the fact that the volume of the small chamber cannot be zeroed or excluded from existence because of a thickness of the spiral element which cannot be made nullified in the actual design of construction.

Reviewing more specifically, as shown further in detail in FIG. 13, an enlarged fragmentary view of the core portions of the spiral elements, in which drawing figure (A) corresponds to FIG. 10 (C), the small chamber 53 defined between the points of contact 52 and 52' of the two complementary spiral elements 1, 2 will be in its working position as shown in a similar manner in FIG. 13 (B), when the spiral element 1 is caused to be moved in revolutionary motion, where the volume of the small chamber 53 turns out to be smallest. Then when the spiral element 1 is moved further in revolution passing this specific point of engagement, the spiral elements 1, 2 are departed away from each other, thus having the points of contact therebetween 52, 52' dissolved accordingly. On this moment, the small chamber 53 as defined between these two spiral elements 1, 2 now turns in communication with the small chambers 3,3 defined outside of each of the spiral elements.

From this locational relationship in the generally known construction of the rotary machine, it is inevitable that the fluid under high pressure confined in the then smallest volume as shown in FIG. 13 (B) is therefore put again in communication with the small chambers 3, 3, instead of being delivered out of the delivery port 4. For this reason, the work done thus far upon the fluid body corresponding to the top clearance volume in question would immediately be turned out to be a loss of work, accordingly.

Also, as it is the general practice of design engineering in the conventional rotary machine construction that the leading ends of the spiral elements 1 and 2 are of a sharp corner, it would then be subjected to damages with a relatively high possibility during the operation. Moreover, this sharp-cornered leading end of the spiral element would generally require an additional number of man-hours in the machining work.

In coping with these drawbacks which are particular to the conventional rotary fluid machines as referred to above, the present inventors have previously proposed the provision of the rotary type fluid machine construction which is equipped with the spiral element of the type as specifically shown in FIG. 14, by way of the frontal elementary view, of the Japanese Patent Applications Nos. 206,088/1982.

Referring more specifically to the construction according to this Japanese Patent Application, the general construction is of such as shown schematically in FIG. 14 that there is provided the stationary spiral element designated at the reference numeral 501, wherein the curves of the radially outer and inner surfaces of the spiral element 501 are designated at 601 and 602, respectively. It is seen that the radially outer curve 601 is defined as an involute curve having the base circle radius b and the starting point A, the curve section E-F of the radially inner curve 602 is an involute curve having the shift in phase of $(\pi-\rho/b)$ with respect to the radially outer curve 601, and the curve section D-E is an arc having the radius R. Also, the connection curve designated at 603 for connecting smoothly the radially outer and inner curves 601 and 602 is an arc having the radius r. The point A is the starting point of the outer curve 601 in the involute curve, and the point B is the boundary point between the outer curve 601 and the connection curve 603, where the both curves share the same tangential line. The point C is the one that is defined sufficiently outside of the radially outer curve 601, and the point D is the boundary point between the inner curves 602 and the connection curve 603, at which point there are two arcs having the radii R and r in osculating relationship with each other. The point E is the boundary point between the arc section (between the points from D to E) of the radially inner curve 602 and the involute curve section E-F, where the both curves share the same tangential line. The point F is seen to be the one which exists sufficiently outside of the inner curve 602.

It is noted that the other revolving spiral element 502 is in the identical construction.

Now, the radii R and r may be given with the following equations; that is $$R=\rho+b\beta+d \quad (1)$$

$$r=b\beta+d \quad (2)$$

where, $\rho$ is the radius of revolutionary motion;

b is the radius of a base circle $$d=\frac{b^2-\left(\frac{\rho}{2}+b\beta\right)^2}{2\left(\frac{\rho}{2}+b\beta\right)} \quad (3)$$

$\beta$ is a parameter.

The parameter $\beta$ is equal to an angle defined by a straight line segment passing the origin 0 and the X-axis in the negative guadrant. Two points of intersection of the straight line segment passing the origin 0 and at the angle of $\beta$ and the base circle are seen existing in the line segments $EO_2$ and $BO_1$. It is also seen that the straight line segments $EO_1$ and $BO_1$ extend in osculation with the base circle at the points of intersection noted above.

More specifically, it is noted that the parameter $\beta$ is defined to be a given marginal condition for the establishment of the involute curve for the radially outer and inner curves in the configuration of the spiral element, and conversely that this parameter $\beta$ would eventually define the marginal points E and B for the attainment of a due involute curve.

According to the general construction of the rotary fluid machine, it is the practice of design engineering such that the curvilinear section extending between the points E and B may appropriately be determined for avoiding contacts of the both spiral elements therebetween, and that the marginal point for abutting contact between these two elements with the curve extending from the outerior point of contact would then turn to be the points E and B. According to this practice of engineering, it is generally accepted that while the point E on the part of the stationary spiral element would abut in contact with the point B of the revolving spiral element, the curved profile of these elements is designed in such a manner that they may depart from each other in their relative motion during the operation.

Now, referring to FIG. 15, there are shown a revolving spiral element at the reference numeral 502 having points of engagement or contact 552 and 552' between these spiral elements, a small space or chamber at 553 defined between the points of contact 552 and 552', and outer spaces or chamber 503, 503, respectively. It is noted that FIG. 15 (A) corresponds to FIG. 13 (A), and FIG. 15 (B) corresponds to FIG. 13 (B), respectively, and that FIGS. 15 (C), 15 (D) and 15 (E) show the positions taken by the spiral element 502, when revolved further in sequence, respectively.

According to the specific construction of this proposition, it is notable that when the both spiral elements 501 and 502 are put to be moved in revolving motion relatively with each other in sequence as seen in FIGS. 15 (A), 15 (B), 15 (C), 15 (D) and 15 (E), the space or volume of the small chamber 553 as defined between the points of contact 552, 552' would continue to decrease gradually till the moment that the points of contact 552 and 552' would eventually merge into one and the same point as shown in FIG. 15 (E), whereupon the current volume of the small chamber 553 would then be turned to be zero or nullified.

As reviewed from the above description, it is noted that because of the so-called top clearance volume being nullified accordingly, otherwise left existing in the conventional construction, the whole volume of fluid thus being put under pressure is then delivered forcedly out of the delivery port (not shown) without any loss at all. Therefore, the total work done upon the fluid by the compression machine would duly be effected, thus preventing any loss of work from occurring which was otherwise inevitable during the operation construction of the conventional rotary fluid machine accordingly.

While the working capacity of the delviery port is neglected in the practice stated above for the convenience of explanation, it is actually required to provide a delivery port at an appropriate position in which there is defined the small chamber 553. It is inevitable in practice that there is produced more or less the top clearance volume in this practice noted above, but this will end to a substantially small extent, so small that it may well be estimated as being substantially null after all.

It is also notable that each of the central leading ends of the spiral elements 501 and 502 is, as typically shown in FIG. 14, of no sharp corner by virtue of the adoption of the arcuate joint or connection curve 603. For this reason, there may well be avoided a risk of breakage or damage of this leading end portion in question from occurring during the operation of the machine, and in addition, it will substantially contribute to an ease of machining of the spiral element that there are provided the arcuate curves in connection between the points D and E of the radially inner curve 602 and in the connection curve 603 per se, respectively.

By virtue of the adoption of the above noted proposition, while many drawbacks may be dissolved accordingly, thus effecting many advantages, there would occasionally be unavoidable the following inconveniences; that is, (I) More specifically, it is noted that there are three factors of design determining the general configuration of the spiral element, which are: the radius b of a base circle for an involute curve, a radius of revolutionary motion $\rho$ and an angular parameter $\beta$ (which represents a marginal condition on the definition of an involute curve). However, in the actual manufacture of the fluid machine, it is the general practice to use the end mill cutter, which would therefore bring a certain practical restriction on the diameter of a mill cutter to be used in the machining conditions. According to the construction as disclosed in the Japanese Patent Application No. 206,088/1982, there is found the case that the use of the end mill cutter of a small diameter should have been forced from the restriction on the curvature R of the arcuate section E-D in the profile of the spiral element. From such restrictions, there would be the case that an error in machining or a period of work of the spiral element be increased inevitably from a shortage of the rigidity of an end mill cutter, or the like.

(II) Further, there would possibly be rendered an abnormal force upon the both spiral elements, when there is a certain degree of error in machining work of the both spiral elements or when there is an error in the relative locational relationship between the both spiral elements.

In the case of a scroll-type compressor, for example, it is the general trend that the abnormal force noted above would possibly grow greater during the operation under a high load where there exists a large difference between the low pressure and high pressure levels in the operation of the machine. Under such a condition, there is a great possibility that the leading end near the arc having the radius r of the spiral element shown in FIG. 14 would then be damaged because of the relatively small rigidity in this leading end portion.

In the fluid machine wherein the both spiral elements are designed to be in contact with each other, since the relative rate of slipping in the radially inward curved surfaces of the both spiral elements would turn out to be much greater than that in the radially outer portions thereof, there would then occur a greater amount of wear or abrasion in the radially inner surface of the element. When the extent of such abrasion would occasionally grow higher than the allowable maximum limit during a high load operation of the machine, thus producing an excessive amount of dust from abrasion in the inside of the compressor or associated parts, which would eventually result in a failure of the machine.

Even in the case that the both spiral elements are designed to be of non-contact type, when there is a certain degree of error in machining work of the both spiral elements, or when there is an error in the relative locational relationship between the both spiral elements incorporated, there would also be a substantial extent of wear or abrasion in the leading end portions of the complementary elements engaged during the operation of the machine, thus possibly resulting in a failure or like disorder.

(III) In the construction of a compressor wherein there are incorporated therein the spiral elements 252, 242 having the configuration as noted hereinbefore, it has sometimes been experienced that when in a high load operation in which there exists generally a substantial difference in pressures as found between the low pressure side and the high pressure side of the machine, there is a case that the radially inner leading end portion of the elements would occasionally be broken during the operation, and this is because the rigidity or stiffness of this specific inner leading end portion of the spiral element as shown by an arrow in FIG. 10 (A) is relatively smaller than that at any other portions.

In addition, in the design of the fluid machine wherein the both spiral elements are installed in mutually contact relationship, there would possibly occur a greater amount of wear or abrasion in the radially inner surface of the element, since the relative rate of slipping in the radially inward curved surfaces of the both spiral elements would turn out to be much greater than that in the radially outer portions thereof. On the other hand, in the case of the fluid machine construction wherein the both spiral elements are designed to be not in contact with each other, when there is a certain error in machining work of the both spiral elements, or an error in the relative locational relationship therebetween when installed together, there would likely be a possibility of breakage or abnormal abrasion in the complementary elements involved, particularly in the leading end portions thereof during the operation of the machine.

SUMMARY OF THE INVENTION

The present invention is therefore materialized to practice in view of such circumstances and inconveniences as noted above and is essentially directed to the provision of an improved rotary type fluid machine, which can afford an efficient solution to these problems, accordingly. (I) Accordingly, it is an object of the present invention to provide an improvement in the configuration of a spiral element for the rotary-type fluid machine that makes it possible to use an end mill cutter having a diameter which is equal to or slightly smaller than the half of a gap or clearance between the opposed blade portions in the spiral element to be worked in the machining operation thereof, thus ensuring an as small as possible error in the machining, and thus making shorter a work period of time.

(II) It is another object of the invention to provide an improvement in the construction of a spiral element to be incorporated in the fluid machine that can prevent from occurring a possible damage or abnormal abrasion in the elements involved, when there is a certain error in machining work of the both spiral elements or an error in the relative locational relationship therebetween when installed together.

(III) It is still another object of the invention to provide an improvement in the configuration of a spiral element that can prevent from occurring a possible damage or abnormal abrasion in the radially inner leading end of the element as encountered during the operation of the fluid machine.

According to the entity of the present invention, there is provided, as briefly summarized, an improved construction of the rotary type fluid machine including two scroll or spiral element, or a stationary spiral element and a revolving spiral element having an identical configuration and disposed therein 180 degrees apart from each other in mutually nested relationship, the revolving spiral element being adapted to revolve in solar motion relationship with respect to the stationary spiral element with a radius of revolutionary motion $\rho$, there may be provided such constructional features in the following; that is, (I) wherein the both spiral means are respectively defined in profile with a radially outer curve segment consisting of an involute curve, a radially inner curve segment consisting of another involute curve in an arc having a radius R, and an arc of a radius r connecting smoothly the radially outer curve segment and the arc having the radius R, in accordance with the geometrical relationship as given by the following equations; i.e., $$R=\rho+b\beta+d$$

$$r=b\beta+d$$

$$d=\frac{b^2-\left(\frac{\rho}{2}+b\beta\right)^2}{2\left(\frac{\rho}{2}+b\beta\right)}$$

where, $$\beta \geqq \frac{\pi+\sqrt{\pi^2-4}}{2}-\frac{\rho}{2b}$$

b is the radius of a base circle of the involute curve.

(II) wherein the both spiral means are defined respectively with a radially outer curve consisting of an involute curve, a radially inner curve consisting of another involute curve having an inner arc of a radius R, and a connection curve having an arc of a radius r and connecting in smooth continuation the radially outer curve and the arc having the radius R, and wherein there is provided a small gap or clearance between the both spiral means when installed in a mutual engagement relationship in such a manner that the whole inner and connection curves or part thereof may be caused to be departed out of the mutual engagement relationship in the range between marginal points for defining a due involute curve determined with an angular parameter $\beta$ as given by the following equations; i.e., $$R=\rho+b\beta+d$$

$$r=b\beta+d$$

$$d=\frac{b^2-\left(\frac{\rho}{2}+b\beta\right)^2}{2\left(\frac{\rho}{2}+b\beta\right)}$$

where, b is the radius of a base circle of the involute curve.

(III) wherein the both spiral means are defined respectively with a radially outer curve consisting of an involute curve, a radially inner curve consisting of another involute curve having an inner arc of a radius R, and a connection curve having an arc of a radius r and connecting in smooth continuation the radially outer curve and the arc having the radius R, and wherein there is provided a small gap or clearance between the both spiral means when installed in a mutual engagement relationship in such a manner that the whole inner and connection curves or part thereof in the range between two points as determined with an angular parameter $(\beta+\Delta\beta)$ in a slightly outer area than marginal points for defining a due involute curve determined with an angular parameter $\beta$, may be caused to be departed out of the mutual engagement relationship, in accordance with the following equations; i.e., $$R=\rho+b\beta+d$$

$$r=b\beta+d$$

$$d=\frac{b^2-\left(\frac{\rho}{2}+b\beta\right)^2}{2\left(\frac{\rho}{2}+b\beta\right)}$$

where, b is the radius of a base circle of the involute curve.

By virtue of such an advantageous construction as noted above, there is assured such effect and function in the following paragraphs (I), (II) and (III); that is, (I) The improvement in the configuration of a spiral element for use in the rotary-type fluid machine with a low cost and a high performance that makes it possible to use an end mill cutter having a substantially large diameter for the machining operation of a gap or clearance between the opposed blade portions in the spiral element to be worked, thus ensuring an as small as possible error in the machining, and thus making shorter a work period of time.

(II) The improvement in the configuration of a spiral element for use in the fluid machine that can contribute to the provision of a fluid machine with a long service life and a high performance by preventing from occurring a possible damage or abnormal abrasion in the elements involved, whereby it may present a marked benefit when put to use in the industry.

(III) The improvement in configuration of a spiral element for use in the fluid machine that can efficiently prevent from occurring a possible abrasion or damages in the radially inner leading end portion of the element as otherwise encountered during the operation in the conventional construction, whereby it may present a high performance fluid machine which brings a marked benefit when put to use in the industry.

Additional features and advantages of the invention will now become more apparent to those skilled in the art upon consideration of the following detailed description of a preferred embodiment exemplifying the best mode of carrying out the invention as presently perceived. The detailed description refers particularly to the accompanying drawings.

DETAILED DESCRIPTION OF THE INVENTION

(First Embodiment of the Invention)

Figure 1:
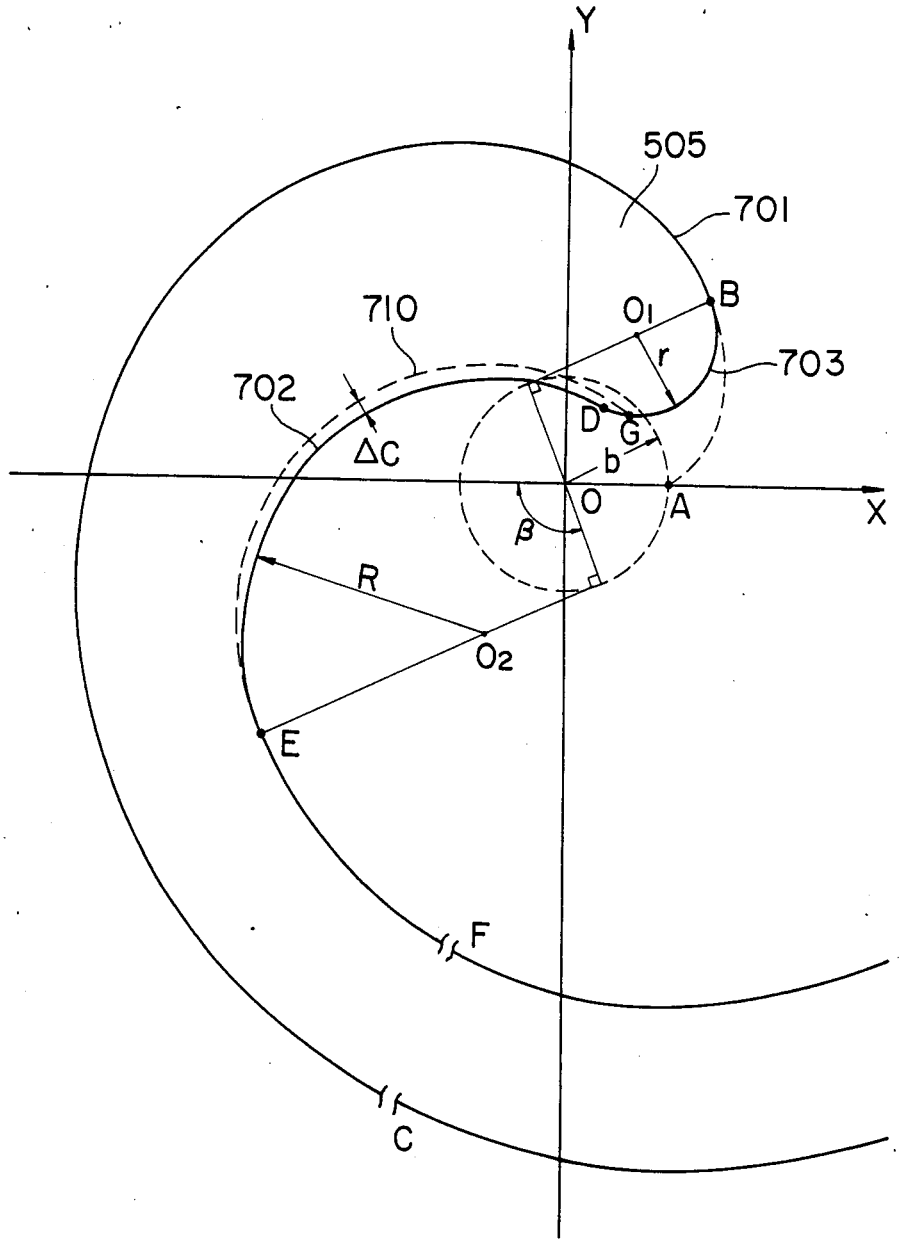
FIG. 1 is a schematic front elevational view showing the configuration of a scroll or spiral element incorporated in the rotary type fluid machine by way of a first preferred embodiment of the present invention.

The present invention will now be explained by way of a first preferred embodiment thereof as adapted in practice to the rotary type fluid machine in reference to the drawings attached herewith. Now, the reference is made to FIG. 1 which is the front elevational view of the spiral element, in which like parts are designated at like reference numerals and in which there is shown such like elements on the same scale as in FIG. 14. Also, it is notable that the characters R, r and d are used in correspondence with those as appeared in the equations (1), (2) and (3) above, and that the parameter $\beta$ is adapted to satisfy the following equation (4); that is, $$\beta \geqq \frac{\pi + \sqrt{\pi^2 - 4}}{2} - \frac{\rho}{2b} \tag{4}$$

In this drawing figure, there is shown a stationary spiral element designated at the reference numeral 505 in profile having a radially outer surface in a curve at 701 and a radially inner surface in a curve at 702. It is also seen that the radially outer curve 701 consists of an involute curve having a point A which is the starting point of the involute curve having a base circle radius b, and also shown is a curvilinear section passing points E and F on the radially inner curve 702, which is an involute curve shifted in its angular phase of $(\pi - \rho/b)$ with respect to the radially outer curve 701, and that a curvilinear section D-E is an arc having a radius R and a center $0_2$ as given by the equation (1). Also, there is shown a connection curve 703, which joints the radially outer curve 701 and the radially inner curve 702, and which is an arc having a radius r and a center $0_1$ as given by the equation (2). The point A is the starting point of the involute curve in the outer curve 701 (having the base circle radius b), and also a point B is a boundary point between the outer curve 701 and the connection curve 703, where the both curves share an identical tangential line.

It is also shown that a point C is the one which exists in an area sufficiently outside of the outer curve 701, and a point D is a boundary point between the inner curve 702 and the connection curve 703, where there are seen two arcs having the radii of R and r, respectively, in an osculating relationship with each other.

A point E is a boundary point existing between the arc D-E on the inner curve 702 and the involute curve E-F, where the both curves share an identical tangential line. A point F is the one existing in an area sufficiently outside of the inner curve 702.

Now, it is seen that the angular parameter $\beta$ represents an angle contained between a straight line passing the origin 0 and the negative quadrant of the X-axis, and that the two intersection points of the straight line passing the origin 0 of the involute base circle and defined at the angle $\beta$ with the base circle are found on the extensions of the straight line $E0_2$ and the straight line $B0_1$, respectively. Also, it is seen that the both straight lines $E0_2$ and $B0_1$ extend in contact with the base circle at the points of intersection noted above, and that these straight lines $E0_2$ and $B0_1$ extend in parallel with each other.

This geometric relationship holds good in the like manner on the part of the revolving spiral element, either.

In such configuration of the spiral element as reviewed above, it is noted that a value of the gap or clearance $T_G$ between the opposed blade surfaces of the spiral element may be given by the following equation (5); that is, $$T_G=\rho b+\rho \quad (5)$$

In this connection, taking a parameter given by the equation (4), the radius R of the arc section of the inner curve may be given by the following equation (6):

$$R \geqq T_G \quad (6)$$

With this configuration of the spiral element, it is now feasible in practice to have the portion in a limited space between the opposed blades of the spiral element and the arc section E-D worked with an end mill cutter having a diameter which is equal to or slightly smaller than the gap or clearance $T_G$ of the spiral element. For this reason, the machining work by using an end mill cutter having a relatively large diameter is then practicable on the spiral element with such dimensional restrictions, thus contribuing to the resolution to an inconvenience as sometimes experienced in the conventional construction of the spiral element.

In connection with the preferred embodiment of the invention as noted above, many useful modifications and variations is practicable as follows;

They are:

(1) As typically shown in FIG. 1 with a broken line, there may also be defined an alternative radially inner curve 710 in the curvilinear section E-G with a small clearance or relief ΔC, which is recessed radially outwardly of the inner curve 702.

In this configuration, the point G is an arbitrary point existing intermediate the points D and B on the connection curve 703, which relief ΔC is exaggerated in scale from the actual extent of recess for the clarity in the illustration, and which relief may be made to a very small extent. (2) While not shown, in place of the provision of the relief ΔC in the radially inner curve as noted in the paragraph (1) above, there may of course be provided an alternative recess or relief ΔC on the part of the connection curve, accordingly.

(3) An alternative configuration is such that one spiral element may be as shown in FIG. 1 and only the complementary spiral element may be provided with curvilinear relief ΔC, which may be formed in combination of the profiles of the both inner and outer curve, as noted in the paragraphs (1) and (2) above.

(4) Also, there may be adopted such an alternative construction that the both spiral elements are formed with a small recess to define a clearance therebetween on the part of the inner curve and connection curve, either.

In either case of element profiles according to the modifications as shown in the paragraphs (1) through (4) above, there is defined only a small clearance ΔC therebetween, which may efficiently bring the advantageous effect as intended by way of the Japanese Patent Application No. 206,088/1982 so designed, thus resulting in a due improvement in the efficiency of the fluid machine, accordingly. (5) In summary, it is to be noted that the present invention may accordingly be adapted to an equal effectual result not only to the compression machine but also to any other installations which incorporate the scroll or spiral elements therein.

(Second Embodiment of the Invention)

Figure 2:
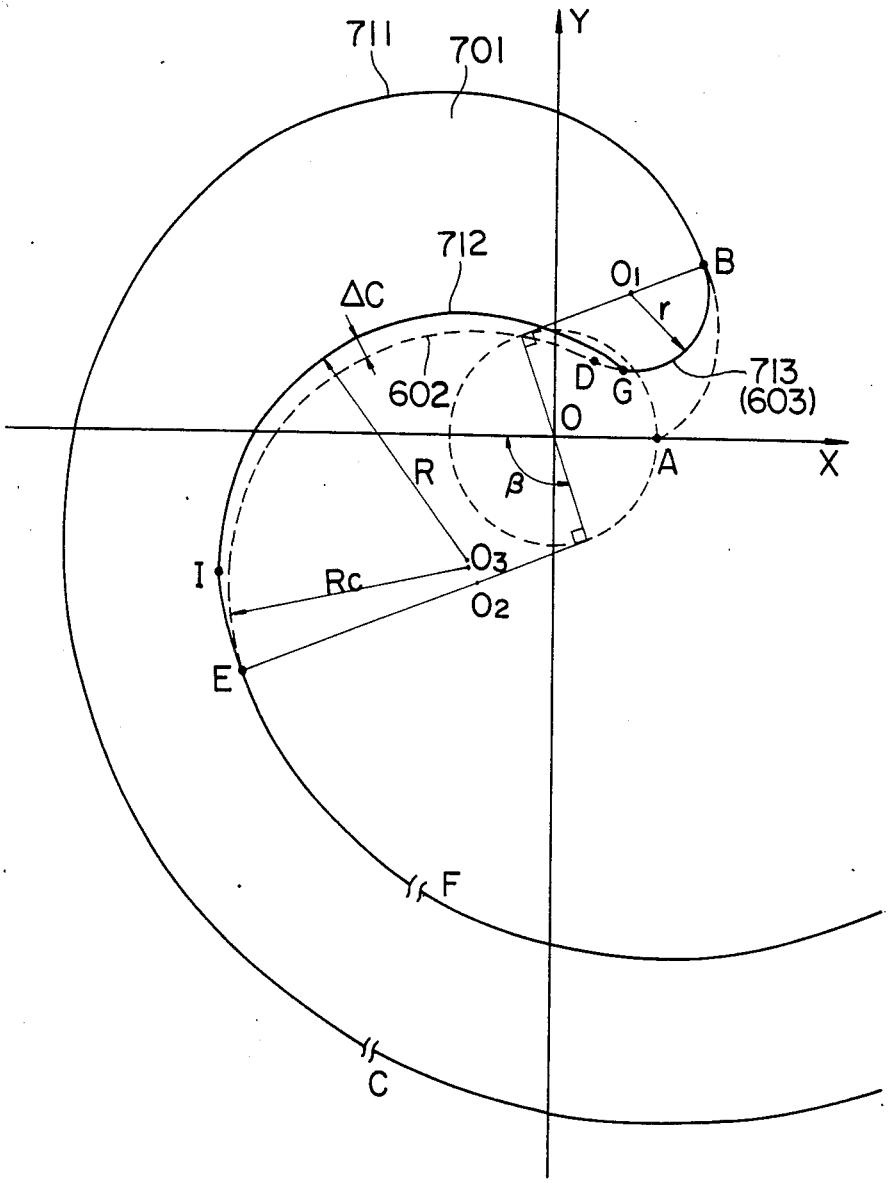
FIG. 2 is a similar front elevational view showing a spiral element by way of a second embodiment of the invention.
Figure 3:
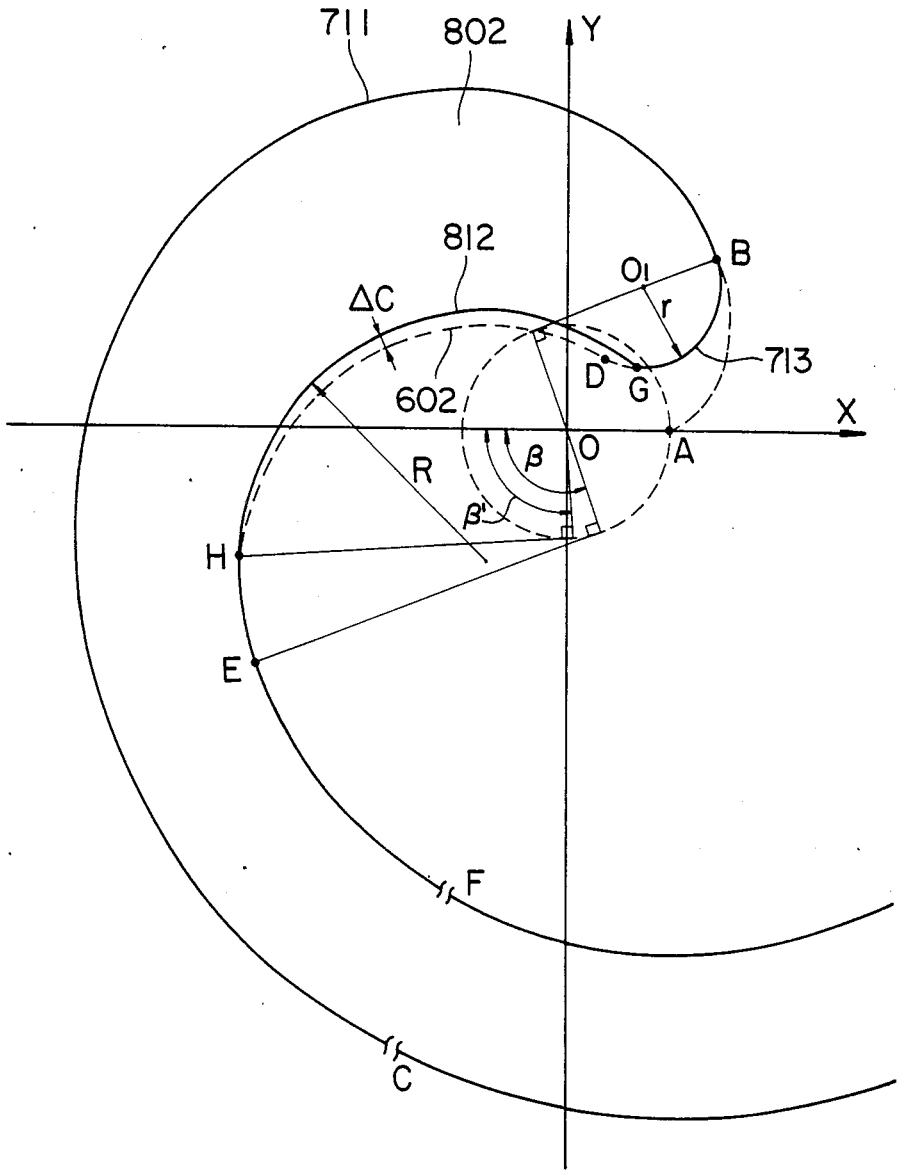
FIGS. 3, 4 and 5 are like front elevational views showing further modifications of the profile of the spiral element shown in FIG. 2, respectively.
Figure 4:
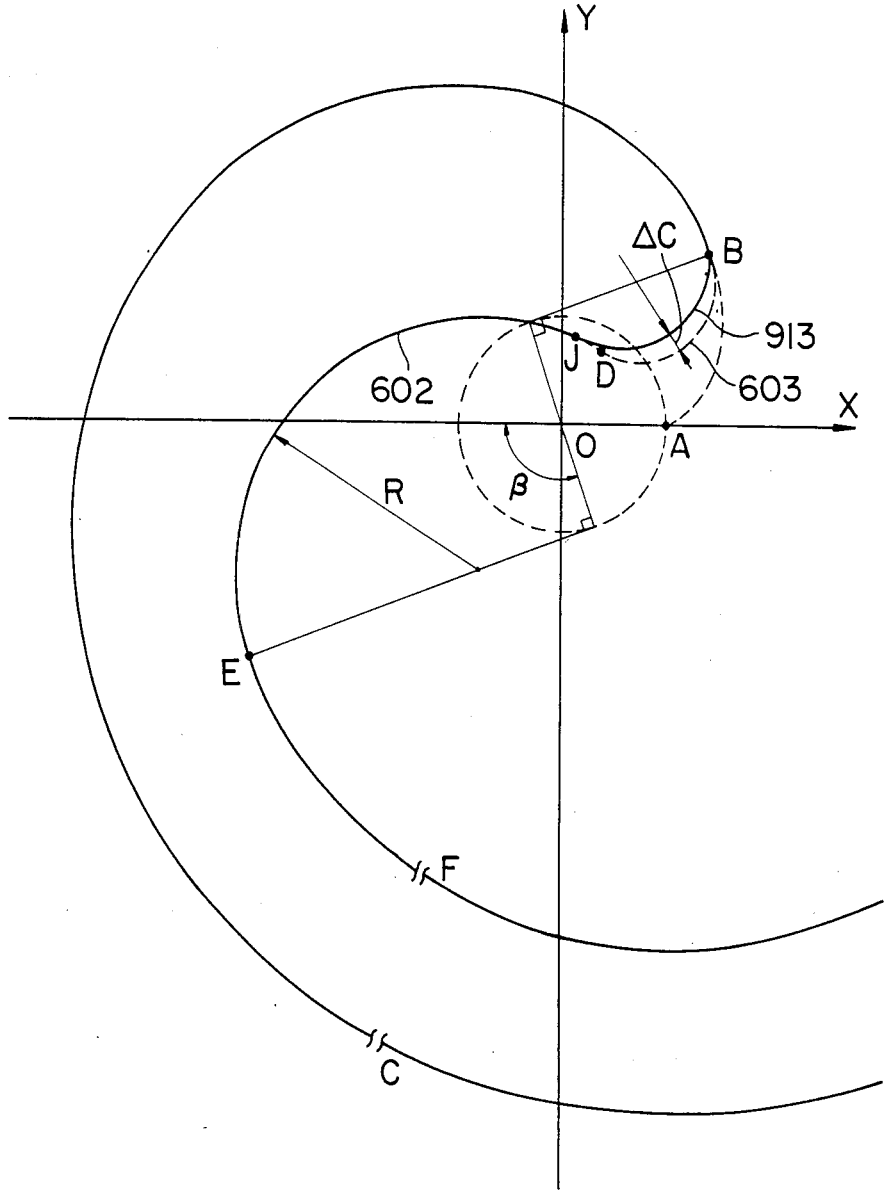
Figure 5:
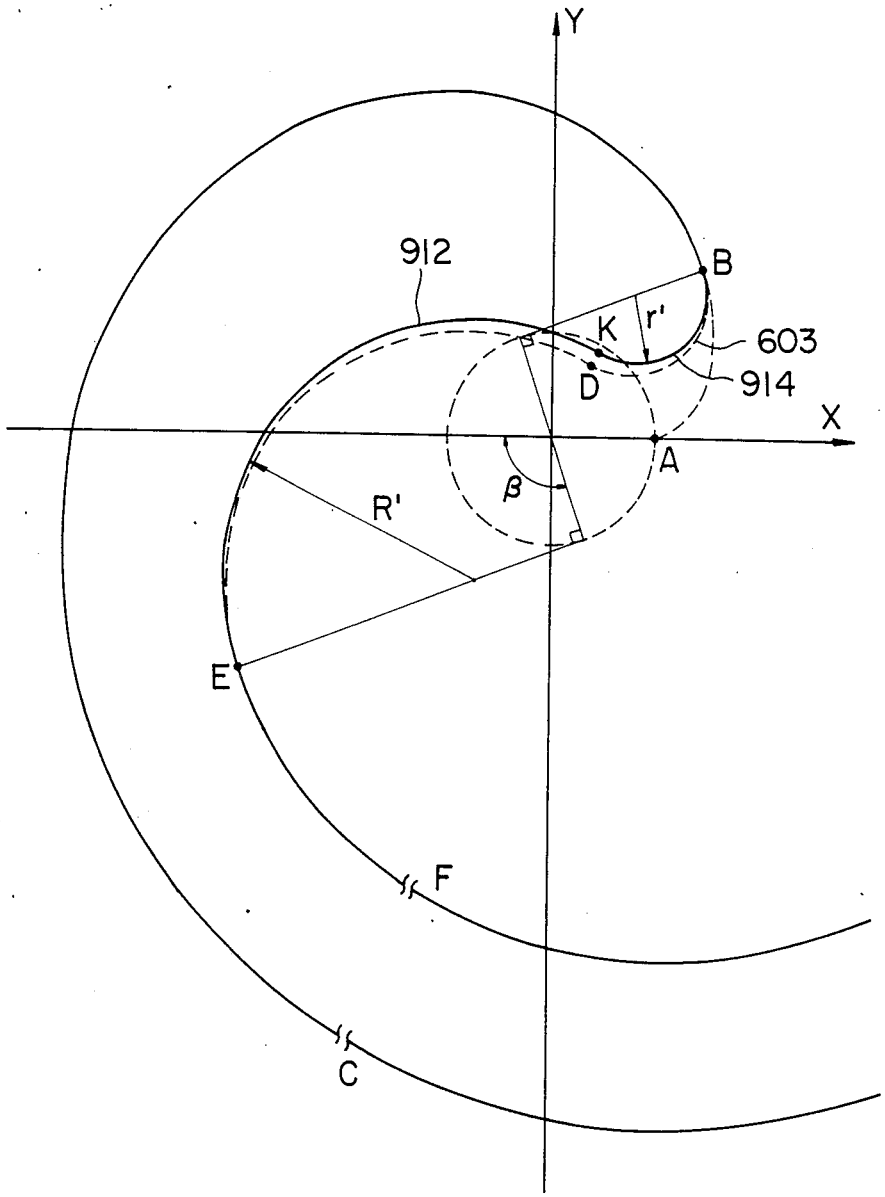

The present invention will now be explained by way of a second preferred embodiment thereof as adapted in practice to the rotary type fluid machine in reference to the drawings attached herewith. FIG. 2 is the front elevational view of the spiral element by way of the second embodiment, and FIGS. 3, 4 and 5 are also similar front elevational views showing further modifications of the invention, respectively.

Figure 14:
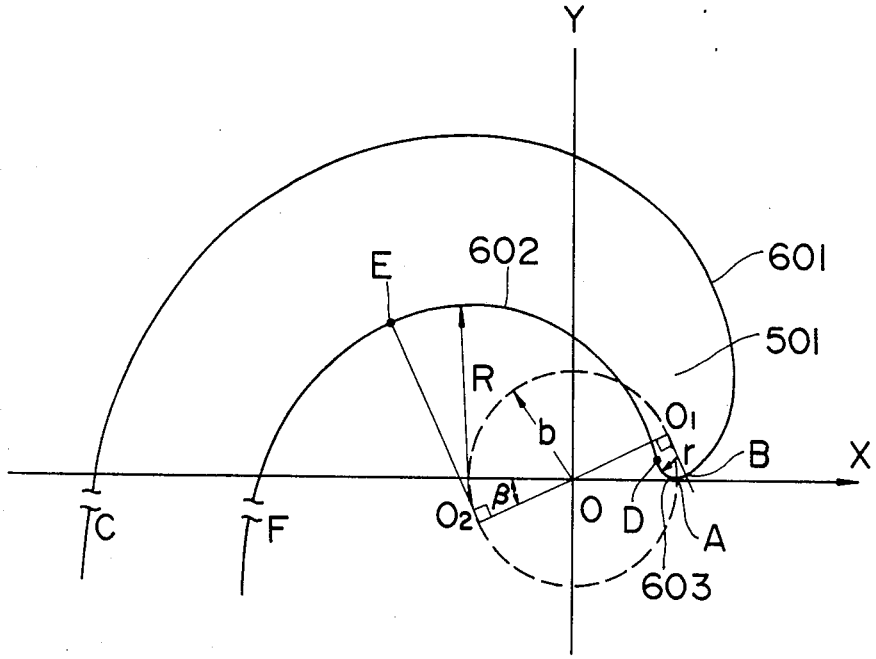
FIG. 14 Prior Art
FIG. 14 is a schematic front elevational view showing part of the profile of the prior art spiral element disclosed in the Japanese Patent Application No. 206,088/1982.
Figure 15A:
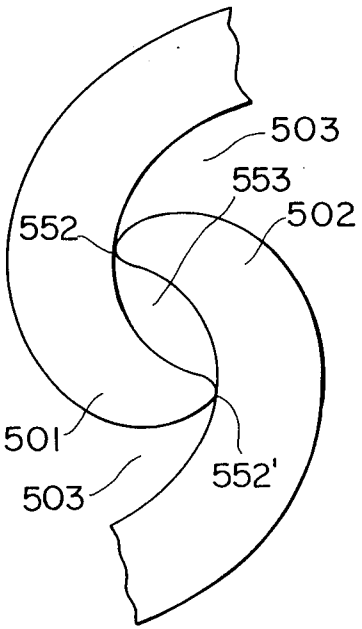
FIG. 15(A) Prior Art
FIG. 15(A), 15(B), 15(C), 15(D), 15(E) are a series of enlarged fragmentary cross-sectional views showing the manner of change in the relative working relationship of the complementary spiral elements shown in FIG. 14, when installed in the scroll-type compressor.
Figure 15B:
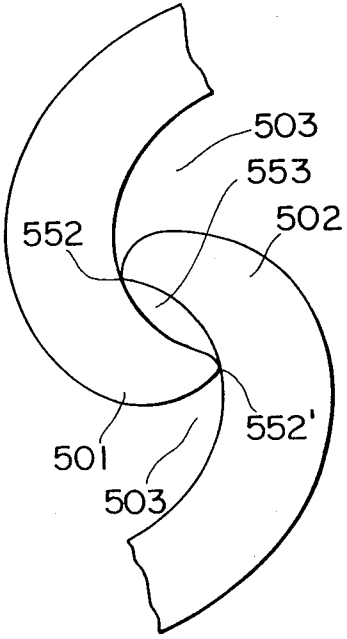
FIG. 15(B) Prior Art
Figure 15C:
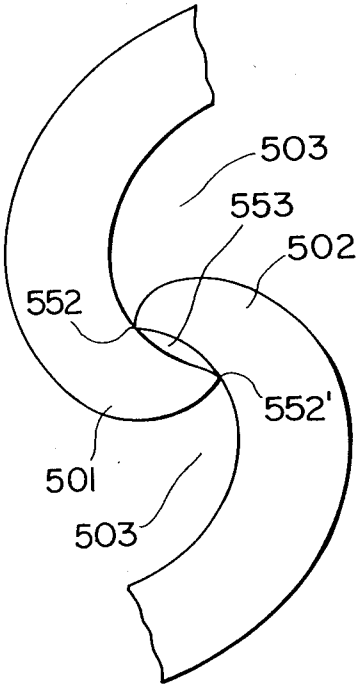
FIG. 15(C) Prior Art
Figure 15D:
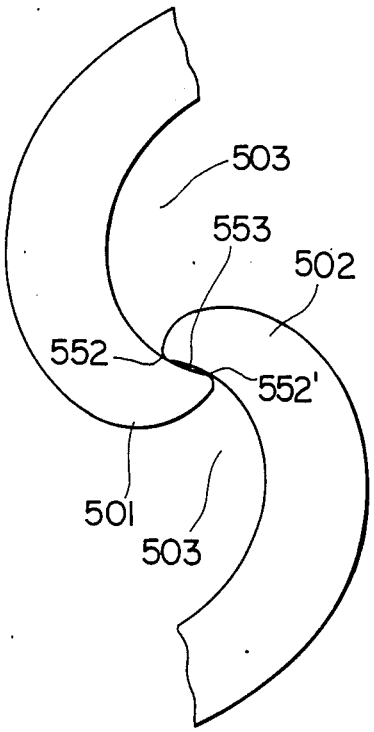
FIG. 15(D) Prior Art
Figure 15E:
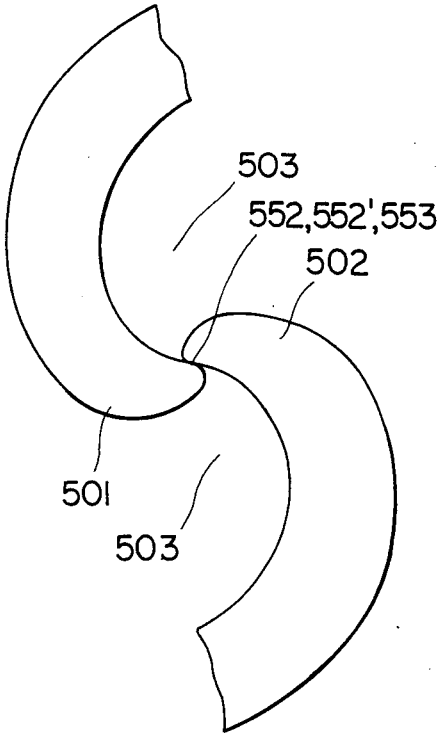
FIG. 15(E) Prior Art

In FIG. 2, like parts are designated at like reference numerals and there is shown such like elements on the same scale as in FIG. 14. Now, referring to FIG. 2, there is shown the stationary spiral element at the reference numeral 701, having the radially outer and inner curves at 711 and 712, respectively.

It is seen that the radially outer curve 711 is an involute curve having a starting point A and that a base circle of a radius b, a curvilinear section E-F of the radially inner curve 712 is of an involute curve having an angular shift of $(\pi-\rho/b)$ with respect to the outer curver 711. It is also seen that a curvilinear section E-I is of an arc having the same radius $R_c$ as the radius of an end mill cutter to applied, and that a section I-G is an arc having a center $0_3$ and a radius R. There is shown a connection curve 713 which is of an arc having a radius r and which joints smoothly the outer curve 711 and the inner curve 712.

In this profile of the spiral element, it is noted that the section E-I-G of the inner curve 712 is drawn with a small gap ΔC nearer the outer curve 711 than the inner curve 602 shown in FIG. 14. While the gap ΔC is rather exaggerated for the clarity in illustration, it is actually only to a small extent of recess.

A point B is a boundary point existing between the outer curve 711 and a connection curve 713, where these curves may share an identical tangential line. It is seen that it is of an involute curve in the area outside of the point B (on the point C's side), while it becomes an arc in the area inside of the point B (on the point G's side).

The point A is the starting point of the outer curve 711, the point C is an arbitrary point existing in the area sufficiently outside of the outer curve 711, and the point F is an arbitrary point existing in the area sufficiently outside of the inner curve 712. The point G is a point of intersection between the arc having a radius R in the inner curve 712 and the connection curve 713, and this point may be on an arbitrary position on an arc having a radius r in the range D-B.

Also, it is notable that this dimensional relationship may hold good in the case of the revolving spiral element, either.

Now, the radii R and r may be given with the following equations; that is $$R=\rho+b\beta+d$$

$$r=b\beta+d$$

where, $\rho$ is the radius of revolutionary motion:, b is the radius of a base circle $$d = \frac{b^2 - \left(\frac{\rho}{2} + b\beta\right)^2}{2\left(\frac{\rho}{2} + b\beta\right)}$$

$\beta$ is a parameter, which represents a marginal range for the choice of an involute curve.

It is seen that a straight line passing the origin 0 and defined at the angle of $\beta$ with respect to the X-axis and the straight line $E0_2$ and the extension of the straight line $B0_1$ intersect orthogonally with each other, and that the straight line segments $E0_2$ and $B0_1$ are in parallel with each other.

The substantial difference found in this embodiment of the invention from that shown in FIG. 14 resides in the configuration of the curvilinear section E-I-G of the inner curve 712 and in the length of the section B-G of the connection curve 713, and it is seen that broken line in FIG. 2 corresponds to the counterpart shown in FIG. 14.

According to the configuration of the spiral element in this embodiment, it is noted that when installed in position, the point F on the involute curve at an arbitrary point sufficiently outside of the inner curve of the stationary spiral element 701 will come to contact with the corresponding point on the involute section of the outer curve on the part of the revolving spiral element (not shown), which point of contact will shift gradually radially inwardly as the revolving spiral element moves in revolution. And the point of contact is shifting to the point E on the inner curve 712 of the stationary spiral element 701, contacting the corresponding point on the outer curve of the revolving spiral element (the same point as the point B on the part of the stationary spiral element). As the revolutionary motion of the spiral element continues still further, it is seen that the both elements are now caused to be moved with a gap of $\Delta C$ defined between the curvilinear section E-D-G of the curve 602 and the section E-I-G of the curve 712.

Therefore, it is notable that the contact engagement between the both spiral elements at the central leading ends thereof will continue till it reaches the point E (in contact with the point B on the complementary spiral element), thereafter a small gap of $\Delta C$ existing between the two in mutual engagement. With such an unique construction of the spiral elements, there may be attained the following effect and function; that is, (1) There will no risk of an abnormal state of excessively forced engagement between the spiral elements installed together may efficiently be prevented from occurring, even if there is a certain degree of error in the machining on these elements, or when these spiral elements are not in a proper condition of installation with each other. By virtue of such advantageous feature, the possibility of breakage in the arc section having the radius r of the spiral element, which exhibits a relatively small rigidity with respect to other portions during a high load operation may accordingly be prevented.

(2) Along with the advantageous effect of preventing such an abnormal state of excessive engagement in the spiral elements, there is attainable a further advantage such that an inconvenience of excessive abrasion in the inner leading end portion of the spiral element where there is observed a relatively large extent of slipping with respect to the complementary element engaging therewith.

(3) With a small gap of $\Delta C$, there may be attained substantially the technical concept as having been materialized in the Japanese Patent Application No. 206,088/1982, thus making it feasible to provide the rotary type fluid machine with the performance of a high efficiency, accordingly.

(4) By virtue of the provision of the advantages in the machining operation on the spiral element such that the curvilinear section E-I of the inner curve 712 may be made with the same radius $R_c$ as that of an end mill cutter to be applied, and that the section I-G is of the arc having the radius R, the machining operation on the spiral element may be operated smoothly without any vital physical restrictions in work.

Accordingly, it is to be noted the entity of the present invention resides in the provision of such construction of the spiral element, in connection with the construction attained in the Japanese Patent Application No. 206,088/1982 that the radially inner curve 712 (602) across the marginal points of defining involute curve E and B as determined by the angular parameter $\beta$ and the connection curve 713 (603) may, when combined in mutual engagement, exhibit a due slight gap in the range E-B during the revolutionary motion of the spiral elements.

In connection with this specific construction of the spiral element, there may be led the modifications and variations in its configuration, as follows.

(1) It is not essential that the radius of the arc E-I shown in FIG. 2 be of the same as that of an end mill cutter to be used, but it may also be greater than that of the end mill cutter. Also, the radius R of the arc I-G may be equal to or greater than the value R as given by the equation (1), and it may also be of an arbitrary curve having a curvature equal to or greater than the radius of an end mill cutter.

In short, it will suffice that there is provided a gap or clearance $\Delta C$ so that the radially inner curve may become closer toward the radially outer curve from the section E-B.

(2) In place of the provision of a gap $\Delta C$ along with the section E-B shown in FIG. 14, there may be provided as desired a gap $\Delta C$ in an arbitrary part of the section E-B only as shown in FIG. 3, either.

In this configuration, there are shown a spiral element designated at the reference numeral 802, with a point H on the inner curve, an arc having the radius R at H-E, and a radially inner curve as drawn in recession from the curve 602 shown in FIG. 14 by a small gap or clearance $\Delta C$. With such configuration of the spiral element, it is constructed such that there are defined the inner curve 602 and the gap $\Delta C$ shown in FIG. 14 in accordance with the point H which corresponds to the parameter $\beta$.

(3) In place of the provision of the gap or clearance $\Delta C$ on the inner curve, there may also be provided the gap $\Delta C$ on the connection curve as shown in FIG. 4.

In this specific configuration, there is shown a connection curve designated at 913 which is drawn in recession with a small gap $\Delta C$ from the connection curve 603 in FIG. 14. This configuration may be defined by providing a point of intersection J with the inner curve 602 in the area on the side of the inner curve (on the point E's side) than a point of intersection D of the connection curve 603 and with the connection curve 602 shown in FIG. 14.

(4) A still further configuration of the spiral element may be constructed in such a manner as shown in FIG. 5 that either of the stationary and revolving spiral elements is as is of the profile shown in FIG. 14, and that there is provided a small gap $\Delta C$ in the both inner and connection curves on the part of the remaining spiral element only.

In this configuration, it is arranged such that the relative dimensions of the radii R, r are $R' > R$ and $r' < r$, respectively.

It is noted that there are shown the inner curve designated at 912, the outer curve at 914, and a point K being a point of connection between the curves 912 and 914, and that there is provided a smaller gap between the curves EKB and EDB, the latter shown in FIG. 14.

In addition, it is also feasible in practice to provide the both spiral elements with the profile shown in FIG. 5, in which the points of intersection R' and r' may come to be in due osculation with each other with the relation making $(R'-r'=\rho)$, thus providing a smooth connection at the joint of curves, accordingly.

According to the modifications as stated in the paragraphs (3) and (4) above, it can be expected that the curvature of a small circle as defined in the central leading end portion of the spiral element would turn to be smaller slightly when compared with the practical examples, which would possibly result in a reduction in the rigidity correspondingly to the reduction in the curvature. However, the gap is so small that this extent of reduction in the curvature would bring no substantial influence, after all.

(5) The present invention can naturally be applied to any other rotary element type machines such as a pump, an expander and the like than the use to a compressor, after all.

(Third Embodiment of the Invention)

Figure 6:
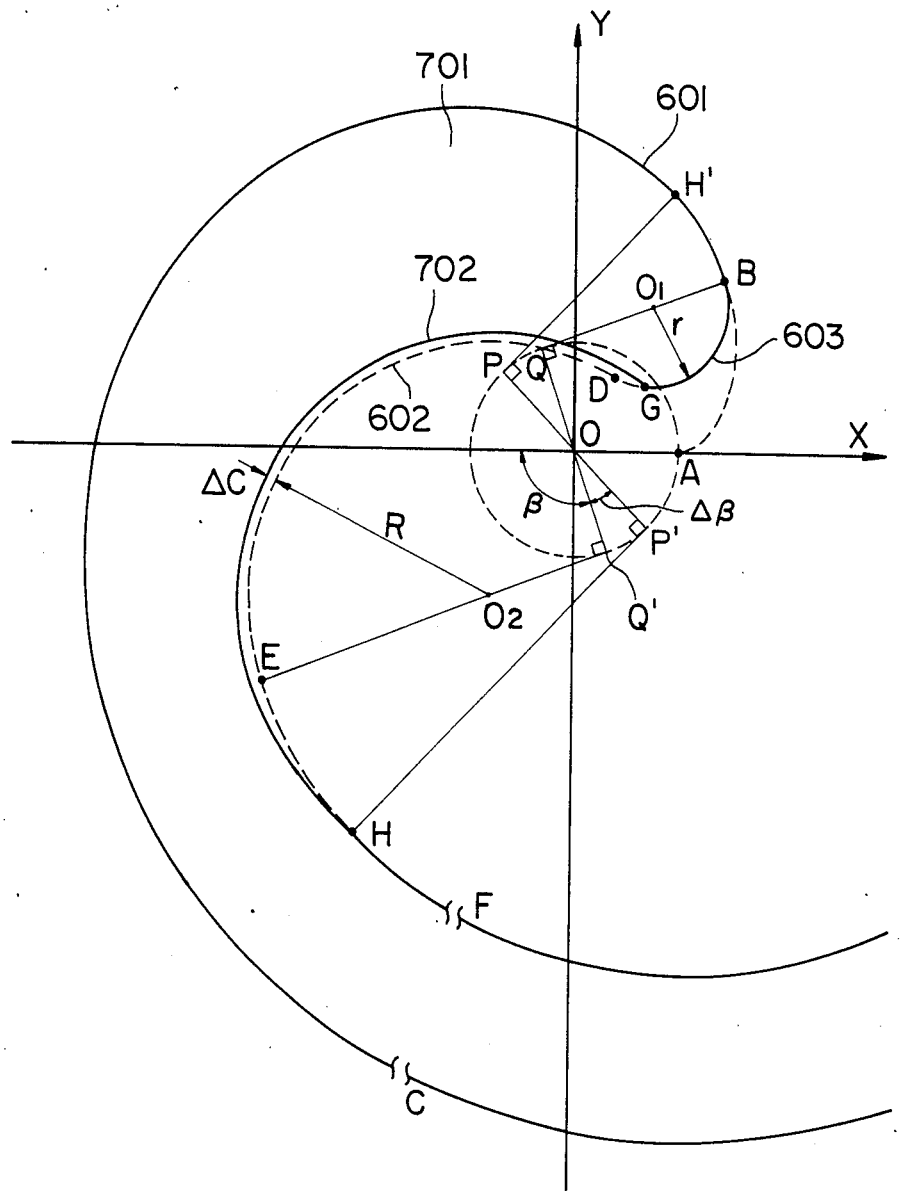
FIG. 6 is a similar front elevational view showing a third embodiment of the invention.
Figure 7A:
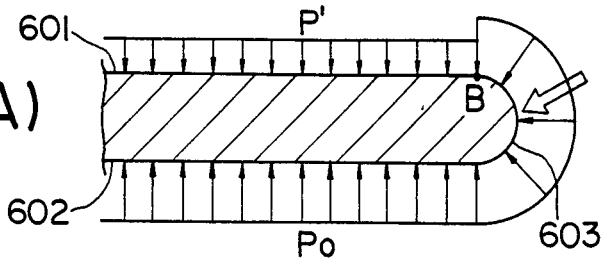
FIG. 7(A), 7(B) are a schematic model diagram showing the distribution of pressures generated around the leading end portion of the spiral element shown in FIG. 6.
Figure 7B:
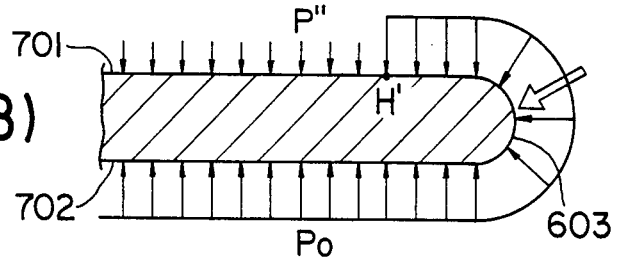
Figure 12:
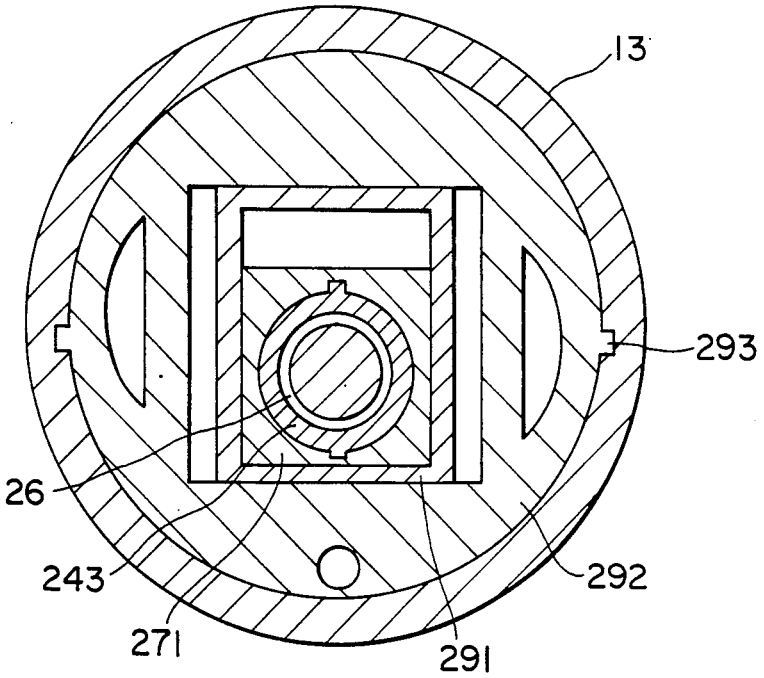
FIG. 12 is a transversal cross-sectional view taken along the line XII—XII in FIG. 11.
Figure 8:
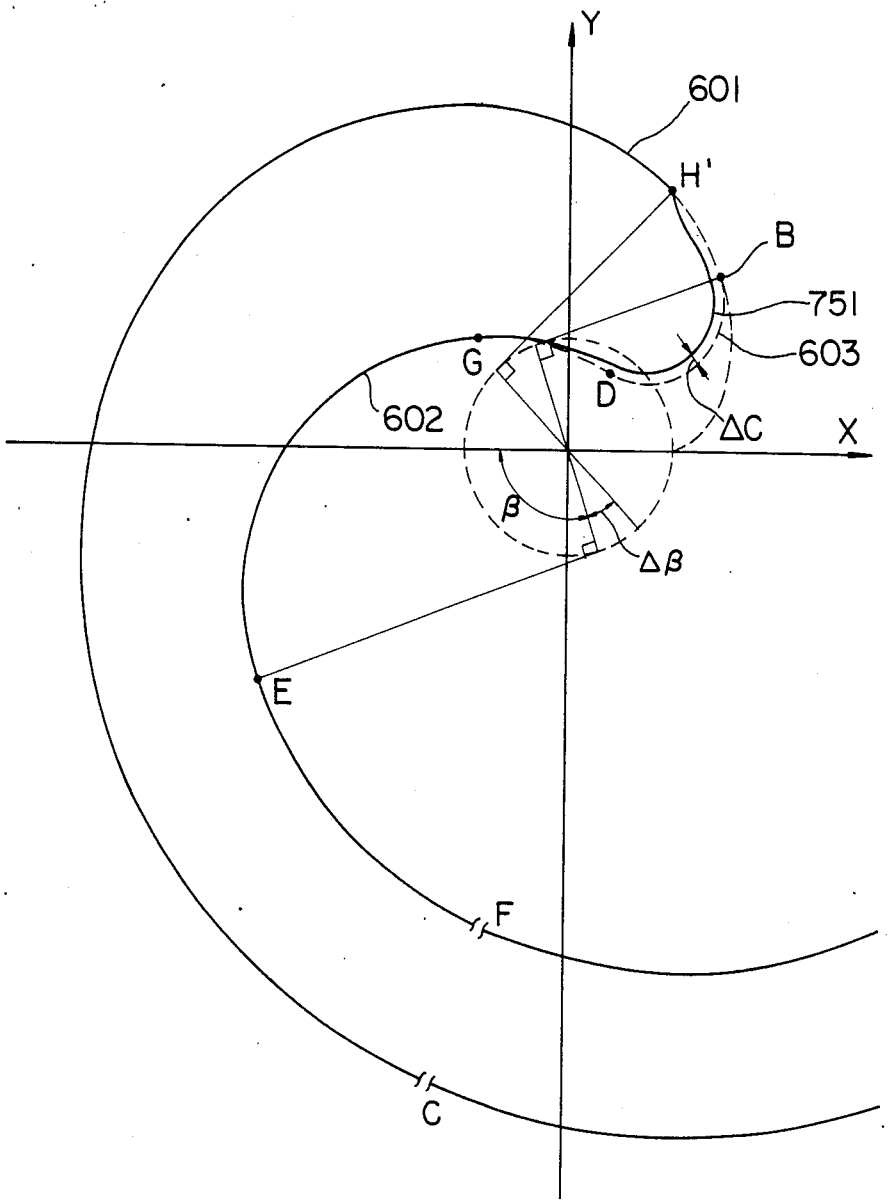
FIGS. 8 and 9 are similar front elevational views showing modifications of the spiral element profile shown in FIG. 6.
Figure 9:
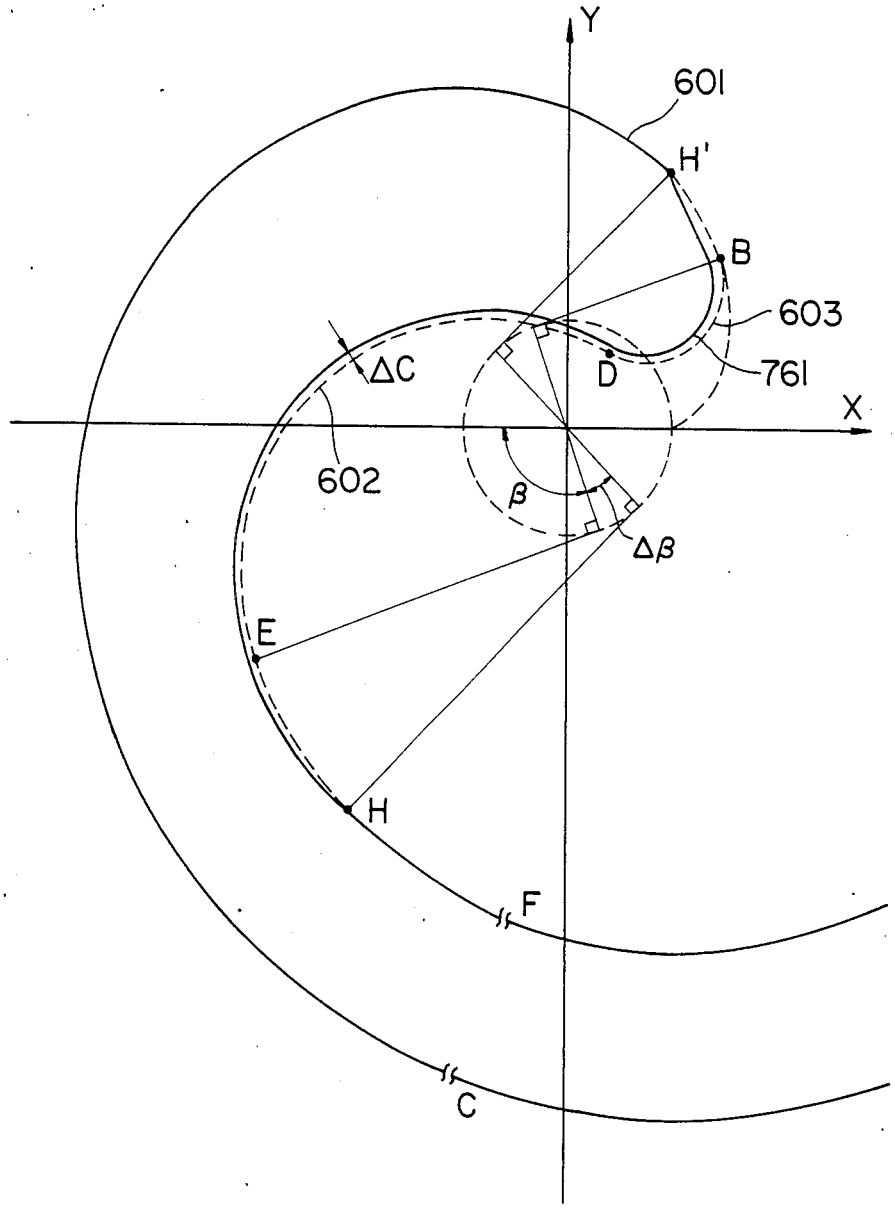
Figure 10A:
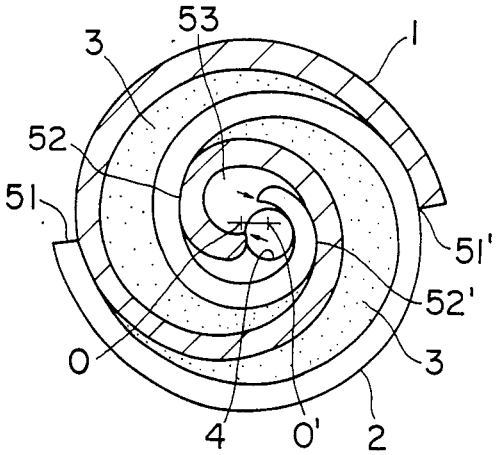
FIG. 10(A), 10(B), 10(C), 10(D) are a series of schematic views showing the principle of operation in sequence of the commonly known scroll-type compression machine.
Figure 10B:
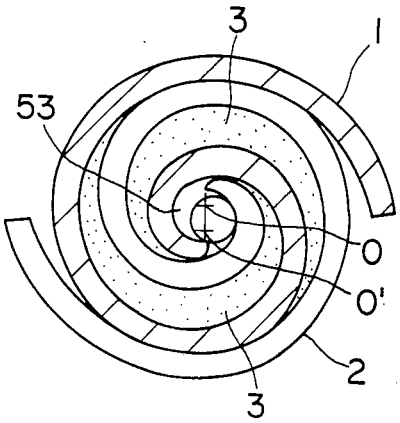
Figure 10C:
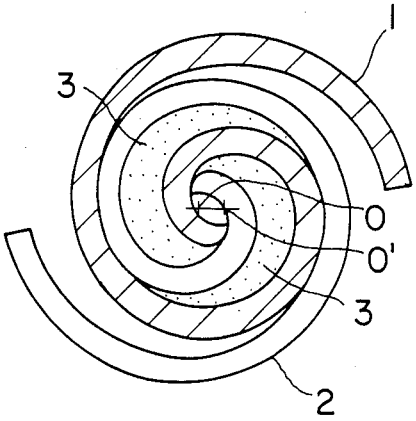
Figure 10D:
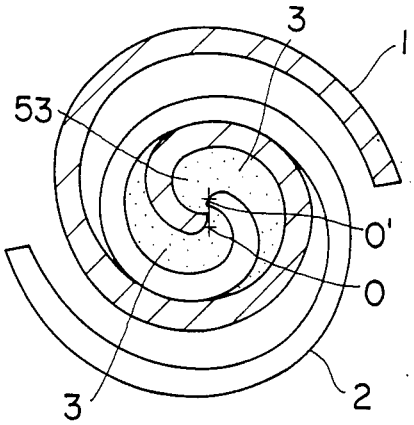
Figure 11:
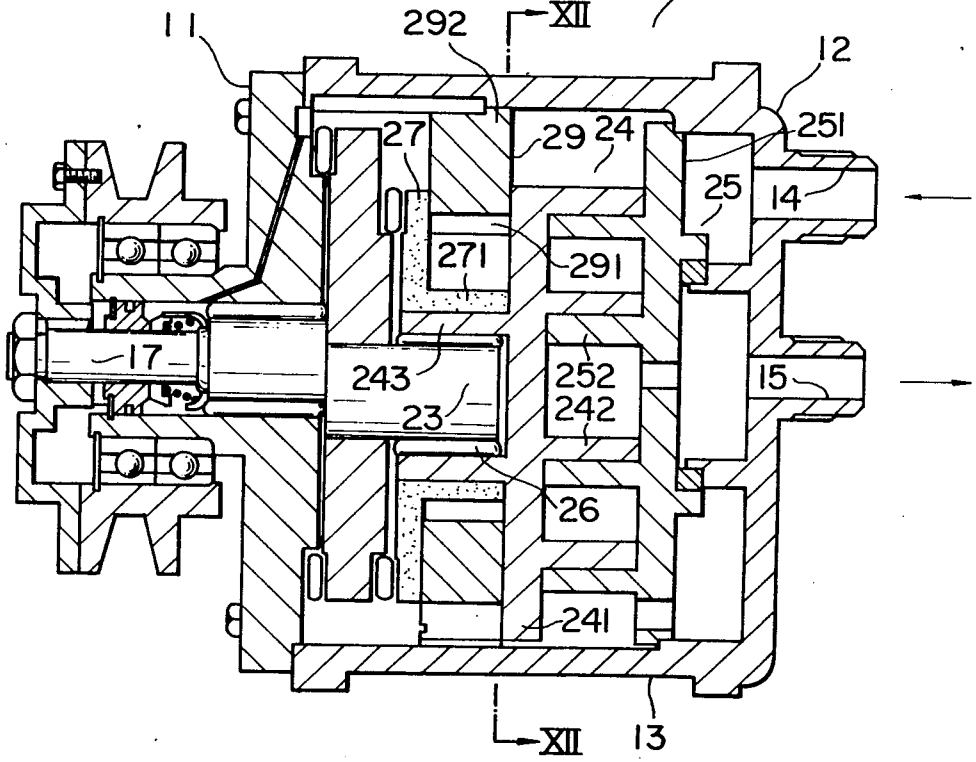
FIG. 11 is a longitudinal cross-sectional view showing the general construction of the commonly known scroll-type compressor assembly.
Figure 13A:
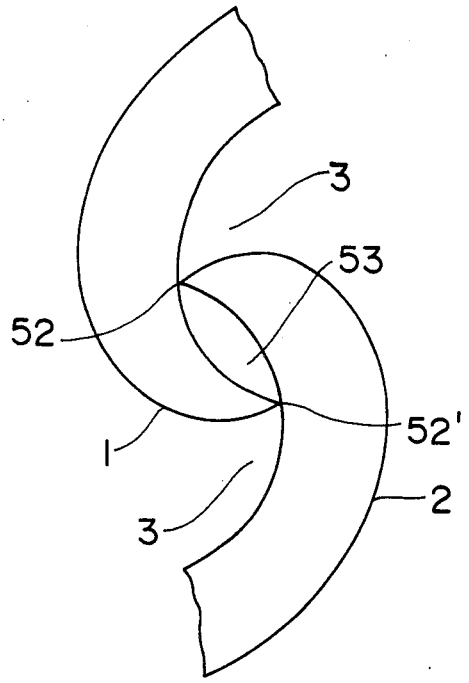
FIG. 13(A), 13(B) are a series of enlarged fragmentary views showing, in cross-section, the manner of change in the relative working relationship of the complementary spiral elements.
Figure 13B:
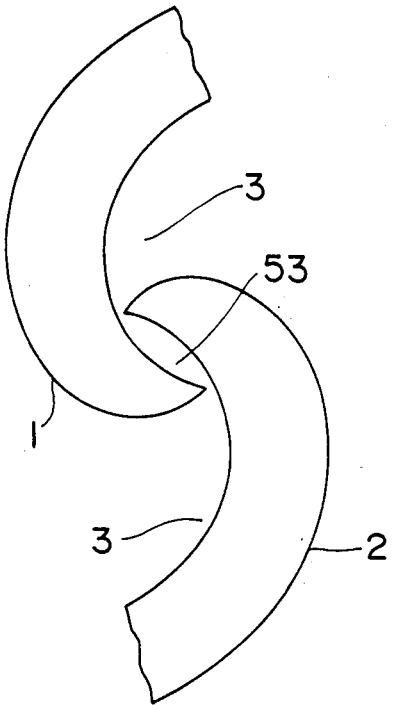

The present invention will now be explained by way of a third preferred embodiment thereof in reference to the drawings attached herewith. FIG. 6 is the front elevational view of the spiral element by way of the third embodiment, FIG. 7 is a fragmentary model diagram showing the distribution of pressures around the inner leading end portion of the spiral element shown in FIG. 6, and FIGS. 8 and 9 are also similar front elevational views showing further modifications of the invention, respectively.

In these drawing figures, like parts are designated at like reference numerals and there is shown such like elements on the same scale as in FIG. 14. Now, referring to FIG. 6, there is shown the stationary spiral element at the reference numeral 701, having the radially outer and connection curves designated at 601 and 603, respectively, which are the same references as in FIG. 14.

In the drawings, the inner curve is designated at 702, which is of an involute curve extending from a point F existing sufficiently outside thereof to a point H which corresponds to a value $(\beta+\Delta\beta)$, the parameter $\beta$ with an increment $\Delta\beta$. In the area inside of the point H, it is seen that the inner curve 702 is defined with a slight recess of $\Delta C$ from the inner curve 602 shown in FIG. 14.

More specifically, it was noted according to the configuration shown in FIG. 14 that this was of an involute defined in the area outside of the point E as determined by the parameter $\beta$ which gives the marginal condition for accepting a due involute curve. In contrast, according to FIG. 6, it is notable that there is defined an involute curve on the inner curve only in the area outside of the point H which corresponds to the parameter $(\beta+\Delta\beta)$, adapted for the area outside of the point E, preferrably with $\Delta\beta$ being defined to be 10 to 15 degrees, or still more.

In this configuration, there are such relationship as $pp' \perp p'H$ and $QQ' \perp Q'H$, where p, p', Q are points on the base circle, and the tangential lines on the base circle at the points p', Q' are p'H and Q'E, respectively.

Also, it is noted that the point G is a point of intersection between the inner curve 702 and the connection curve 603, which exists in the section B-D on the connection curve 603. The point H' is a point of intersection of the tangential line in osculation with the base circle from the point P with the outer curve 601, the radius r of the connection curve 603 being the same as that shown in FIG. 14, and the same dimensional relationship may keep good in the stationary spiral element.

If the both spiral elements are caused to move in revolution relatively when installed in mutual engaging relationship, it is notable that there occurs first a state of engagement at the point on the involute section on the outer curve on the part of the revolving spiral element which corresponds to the outer point F of the involute curve in the inner curve of the stationary spiral element, this state of engagement progressing towards the inner core portion of the element. Then, it may be observed that the point H on the involute section of the inner curve of the stationary spiral element would come into engagement with the point H' on the involute section of the outer curve of the revolving spiral element, thereafter the both elements revolving relatively with a small gap $\Delta C$.

Referring more specifically to the configuration shown in FIG. 14, there was observed the state of engagement at the points E and B as determined by the parameter for the marginal condition of accepting a due involute. In contrast, according to the construction of this embodiment, it is notable that this state of mutual engagement in the complementary elements will cease and begin to depart from each other with an advance value of $\Delta\beta$.

At this moment, there exists a load of delivery pressure or relatively high pressure $P_o$ about the inner area or nearer the connection curve 603 of the inner curve 702 where the both spiral elements are in mutual engagement prior to the departure from each other, at the point near the connection curve 603 of the outer curve 601, and on the connection curve per se. On the other hand, in the areas such as outside of the point of engagement in the outer curve or outside of the point of engagement in the inner curve, there is rendered a relatively low pressure load p' under the stage of growing compression.

Now, reviewing by way of a schematic model relating to the distribution of pressures around the spiral elements the state that the both spiral elements are beginning to depart from each other, it is as shown in FIG. 7 (B), while FIG. 7 (A) shows the state of the configuration shown in FIG. 14.

More specifically, according to the configuration of the spiral element shown in FIG. 14, it is observed as schematically shown in FIG. 7 (A) that there is a change in pressure distribution from P' to $P_o$ at the point B near the point of an arrow indication where the rigidity of the leading end portion of the spiral element is relatively small. In contrast, it is seen from FIG. 7 (B)

showing the improvement in configuration of the spiral element according to the present invention that there occurs a change in pressure at the point H' which is located at a substantial distance away from the point of an arrow.

With such a pressure deviation occurring in the configuration of the spiral element as shown in FIG. 14, it is noted that the element would suffer from a deformation at the point of arrow shown in FIG. 7 (A) owing to a differential pressure ($P_o - P'$, neglecting a mechanical loss from the engagement between the both elements), thus generating a corresponding stress thereto. However, in the configuration of the spiral element according to the present invention, it is notable as shown in FIG. 7 (B) that a current stress generated at the point of arrow would turn to balance and thus to be relatively small, which would then contribute substantially to the prevention of a possible breakage of that portion of the element from occurring, accordingly.

On the other hand, it is as noted previously that there is observed a substantially greater rate of relatively slipping in the surface of mutual engagement of the spiral elements as it shifts in motion toward the inner or central portion thereof, which therefore means a greater rate of abrasion in the point of engagement of the elements involved. In contrast, since there is observed the mutual engagement of the elements exclusively in the area where the rate of relative slipping of the elements is substantially smaller than that of the conventional configuration, the resultant rate of abrasion of the element would then turn to be reduced substantially.

In addition, in an event that there is occasionally an error in the machining or in the installation work of the spiral elements, an abnormal contact or engagement between the complementary elements would be inevitable even in the non-contact type. Under such conditions, however, such an abnormal engagement in the inner leading end portions of the spiral elements according to the present invention could efficiently be avoided. As a consequence, there would therefore occur no abrasion or breakage in that leading end portions of the complementary elements, accordingly.

Furthermore, as the amount of recess or gap $\Delta C$ in the configuration of the spiral element according to the invention is only small, it is to be noted that the advantages as materialized from the Japanese Patent Application No. 206,088/1982 may turn to be substantiated accordingly without any sacrifice, thus contributing to a high efficiency performance of the entire fluid machine, after all.

In connection with the advantageous construction of the spiral elements as incorporated in the rotary fluid machine particular to the present invention as reviewed in the preferred embodiments hereinbefore, there may be attained many useful modifications and variations in practice, as follows.

They are:

(1) The modification in that in place of the provision of the identical configuration for the both stationary and revolving spiral elements to be incorporated in the fluid machine having a point of departure in the engagement of the two elements with one and the same parameter $(\beta+\Delta\beta)$, the provision of the spiral element with different configurations such that one of the spiral elements has a parameter of $(\beta+\Delta\beta)$, while the other element is of a parameter $(\beta+\Delta\beta')$, $(\Delta\beta\neq\Delta\beta')$, so that these elements may depart from the relationship of engagement from each other at different points of correspondence.

(2) The modification in that in place of the provision of the relief $\Delta C$ in the radially inner curve of the spiral element, there may be provided an alternative recess or relief 66 C on the part of the radially outer curve, as typically shown in FIG. 8.

In this modification, it is constructed that there is provided a smaller gap or recess $\Delta C$ than the conventional profile curves 601, 603 and 602, in the curvilinear section extending from the point H' on the outer curve along part thereof and along parts of the connection curve and the inner curve in correspondence with the parameter $(\beta+\Delta\beta)$, thus forming an arbitrary curve 751. Then, a point of intersection G of thus-obtained curve 751 with the inner curve 602 may be determined appropriately in the range between the points D and E.

With such construction of the both spiral elements, there is attainable the substantially same effect as that shown in FIG. 6.

However, the curve 751 having a more inward recess is drawn in place of the connection curve 603. While this curve may bring a little smaller rigidity in the construction of this curve, this would result in substantially no influences as the gap $\Delta C$ is merely of a small value.

(3) The modification as shown in FIG. 9 in that there is provided one of the spiral elements having the same configuration as that shown in FIG. 14, while the other element only may be of a profile curve 761 wherein there is given a small gap of $\Delta C$ between the points H and H' so that the two elements may be departed out of their mutual engagement relationship at the points H and H' which are determined with the parameter $(\beta+\Delta\beta)$, and are outer than the points E and B determined with the parameter $\beta$.

In this modification, it is also feasible in practice that instead of the provision of the points H, H' as the both corresponding to one and the same parameter $(\beta+\Delta\beta)$, there may be provided the point H, for instance, having the parameter $(\beta+\Delta\beta)$, while the point H' having the parameter $(\beta+\Delta\beta')$, $(\Delta\beta\neq\Delta\beta')$, respectively.

(5) In summary, it is to be noted that the present invention may accordingly be adapted not only to the rotary-type compressor, but also to any other installations which incorporate the scroll or spiral elements therein such as a pump unit, a fluid expander, and the like to an equal effectual result.

While the typical preferred embodiments of the present invention has been described fully hereibefore, it is to be understood that the present invention is not intended to be restricted to the details of the specific constructions shown in the preferred embodiments, but to contrary, many changes and modifications may be made in the foregoing teachings without any restriction thereto and without departing from the spirit and scope of the invention.

It is also to be understood that the appended claims are intended to cover all of such generic and specific features particular to the invention as disclosed herein and all statements relating to the scope of the invention, which as a matter of language might be said to fall thereunder.

What is claimed is:

1. A rotary type fluid machine comprising stationary spiral means and revolving spiral means respectively having a substantially identical configuration and disposed 180 degrees apart from each other in mutually nested relationship, said revolving spiral means being adapted to revolve in solar motion relationship with said stationary spiral means with a radius $\rho$ or revolutionary motion wherein said both spiral means are respectively formed by an outer curve consisting of an involute curve, an inner curve consisting of an involute curve having an inner arc of a radius R, and a connection curve having an arc of a radius r and connecting said outer curve and said arc having the radius R in a smooth manner so that fluid can be sucked into and delivered out of the fluid machine, characterized in that said both spiral means are respectively formed in accordance with the following equations; i.e., $$R=\rho+b\beta+d$$

$$r=b\beta+d$$

$$d=\frac{b^2-\left(\frac{\rho}{2}+b\beta\right)^2}{2\left(\frac{\rho}{2}+b\beta\right)}$$

wherein $$\beta \geqq \frac{\pi+\sqrt{\pi^2-4}}{2}-\frac{\rho}{2b}$$

and b is the radius of a base circle of said involute curve.

2. A rotary type fluid machine comprising stationary spiral means and revolving spiral means respectively having a substantially identical configuration and disposed 180 degrees apart from each other in mutually nested relationship, said revolving spiral means being adapted to revolve in solar motion relationship with said stationary spiral means with a radius $\rho$ of revolutionary motion wherein said both spiral means are respectively formed by an outer curve consisting of an involute curve, an inner curve consisting of an involute curve having an inner arc of a radius R, and a connection curve having an arc of a radius r and connecting said outer curve and said arc having the radius R in a smooth manner so that fluid cna be sucked into and delivered out of the fluid machine, characterized in that there is provided a small gap or clearance between said both spiral means in such a manner as part or the whole of said inner curve and said connection curve between the marginal points of said involute curve determined with the parameter $\beta$ cannot come in contact with each other, in accordance with the following equations; i.e., $$R=\rho+b\beta+d$$

$$r=b\beta+d$$

$$d=\frac{b^2-\left(\frac{\rho}{2}+b\beta\right)^2}{2\left(\frac{\rho}{2}+b\beta\right)}$$

wherein b is the radius of a base circle of said involute curve.

3. A rotary type fluid machine comprising stationary spiral means and revolving spiral means respectively having a substantially identical configuration and disposed 180 degrees apart from each other in mutually nested relationship, said revolving spiral means being adapted to revolve in solar motion relationship with said stationary spiral means with a radius $\rho$ of revolutionary motion wherein said both spiral means are respectively formed by an outer curve consisting of an involute curve, an inner curve consisting of an involute curve having an inner arc of a radius R, and a connection curve having an arc of a radius r and connecting said outer curve and said arc having the radius R in a smooth manner so that fluid can be sucked into and delivered out of the fluid machine, characterized in that there is provided a small gap or clearance between said both spiral means in such a manner as part or the whole of said inner curve and said connection curve between two points determined with $\beta+\Delta\beta$ somewhat outwardly between the maginal points of said involute curve determined with the parameter $\beta$ cannot come into contact with each other in accordance with the following equations; i.e., $$R=\rho+b\beta+d$$

$$r=b\beta+d$$

$$d=\frac{b^2-\left(\frac{\rho}{2}+b\beta\right)^2}{2\left(\frac{\rho}{2}+b\beta\right)}$$

wherein b is the radius of a base circle of said involute curve.

* * * * *